United States Patent [19]

Winkler et al.

[11] 4,440,166

[45] Apr. 3, 1984

[54] ELECTRICALLY AND MECHANICALLY CONTROLLABLE CLOSED CIRCUIT RESPIRATOR

[75] Inventors: Jörg Winkler, Stockelsdorf; Hans Matthiessen, Gross Parin; Ernst Warncke, Lübeck; Adalbert Pasternack, Bad Schwartau, all of Fed. Rep. of Germany

[73] Assignee: Drägerwerk Aktiengesellschaft, Fed. Rep. of Germany

[21] Appl. No.: 357,335

[22] Filed: Mar. 11, 1982

[30] Foreign Application Priority Data

Mar. 13, 1981 [DE] Fed. Rep. of Germany ..... 3109660

[51] Int. Cl.[3] ..... A62B 7/10

[52] U.S. Cl. ..... 128/204.22; 128/205.24; 128/202.22

[58] Field of Search ..... 128/202.22, 204.22, 128/205.12, 204.26, 204.21

[56] References Cited

U.S. PATENT DOCUMENTS

| | | | |
|---|---|---|---|
| 2,818,860 | 1/1958 | Holm et al. | 128/202.22 |
| 3,252,458 | 5/1966 | Krasberg | 128/202.22 |
| 3,556,098 | 1/1971 | Kanwisher et al. | 128/202.22 |
| 3,710,553 | 1/1973 | Parker et al. | 128/204.22 |
| 3,957,044 | 5/1976 | Fletcher et al. | 128/202.22 |
| 4,056,098 | 11/1977 | Michel et al. | 128/204.22 |

FOREIGN PATENT DOCUMENTS

| | | | |
|---|---|---|---|
| 195786 | 11/1935 | Switzerland | 128/202.22 |
| 389358 | 3/1933 | United Kingdom | 128/202.22 |
| 799635 | 8/1958 | United Kingdom | 128/205.12 |

*Primary Examiner*—Henry J. Recla

*Attorney, Agent, or Firm*—McGlew and Tuttle

[57] ABSTRACT

A closed cycle respirator is disclosed which includes a respiration air cycle having a breathing bag and a carbon dioxide absorber with connecting lines between the breathing bag and absorber and to a junction adapted for use by the user of the equipment. A pressurized oxygen bottle is provided with a controllable valve for supplying oxygen to the cycle in case the oxygen drops below a selected value in the breathing bag. In case of failure of the controllable valve, a separate oxygen supply connection is provided to the breathing cycle with a valve which senses a reduction of pressure in the breathing cycle and opens the connection to the oxygen bottle for emergency supply of oxygen to the cycle.

8 Claims, 2 Drawing Figures

ELECTRICALLY AND MECHANICALLY CONTROLLABLE CLOSED CIRCUIT RESPIRATOR

FIELD AND BACKGROUND OF THE INVENTION

The present invention relates in general to respirators and in particular to a new and useful closed circle respirator having an oxygen supply with an emergency passage for oxygen and control valve for that passage.

Respirators operating with an electric control on the cycle or rebreather principle make it possible to maintain the oxygen in the cycled breathing air at a desired normal percentage of about 21% independently of the surrounding pressure, e.g. when used as diving equipment. But it must be assured that the user of the equipment can safely continue to work also in case the electric breathing gas control should fail or that he can at least retreat to the safety of his starting base.

In a known closed cycle backpack respirator, the oxygen partial pressure in the cycle is maintained at a desired value by an electronic oxygen regulator.

In a first form of this device, the cycle comprises a breathing connection with mouthpiece and one-way valves for two breathing bags, namely one each on the inhaling and exhaling sides, which are connected together via a $CO_2$ absorption cartridge. Feeding of the required oxygen is effected from a pressure gas bottle through a parallel connection of a throttle adjustable with a handwheel and a solenoid valve, which is closed in the inoperative state, on the entrance side of the absorption cartridge. An electro-chemical oxygen sensor is provided on the exit side of the absorption cartridge and regulates the oxygen partial pressure in the cycle to an adjustable nominal value via an electronic control device and the solenoid valve connected therewith. The measured value of the oxygen partial pressure is visible on an indicator which is worn on a wristband. The adjustable throttle is set so that it assures the minimum oxygen requirement needed for the user's survival. The normal consumption is then replenished via the solenoid valve.

In a second form, the replenishment of the consumed oxygen is effected via a series arrangement of a fixed throttle and a solenoid valve which is actuated by the control device and is open in the inoperative state, into the breathing bag located on the inhaling side. In case of breakdown, such as failure of the solenoid valve, an optical and/or acoustic warning signal is given when the signal of the sensor falls below a limit value. Then, through manual actuation of a switching device, the solenoid valve is by-passed and oxygen supplied continuously through the fixed throttle.

A disadvantage is that although an emergency supply is maintained in case of breakdown in the first form of the device, it is not sufficient for the normal requirement, as may be necessary also for retreat. Therefore, unless the failure is noticed by continuously watching the indicator, a dangerous oxygen depletion in the cycle may occur just the same. In the second form the device, manual switching is necessary in case of breakdown. This presupposes that the breakdown is recognized in time by watching the indicator or the alarm and that the user is then still able to act. (See U.S. Pat. No. 3,252,458).

In a known cycle apparatus, in particular for underwater work, the breathing gas, controlled by one-way flap valves, passes from a mixing chamber via a mouthpiece, which may perhaps be disposed also in a mask, to the user and thence via a breathing bag and a $CO_2$ receiver back into the mixing chamber. A safety valve at the breathing bag relieves any overpressure in the surrounding medium. A gas bottle containing an inert gas-oxygen mixture is connected to the cycle via a pressure regulating valve and a pressure compensating valve as well as a possible, manually operated pushbutton valve. The cycle can thus be filled automatically or by hand. A second gas bottle containing oxygen is connected with the mixing chamber via a pressure regulating valve and a manually operated pushbutton valve. In parallel with the pushbutton valve, a solenoid disconnect valve and a solenoid valve, which are actuated via an electric circuit, are arranged in series. The circuit is connected with two sensors disposed in the mixing chamber, one of which picks up the total pressure and the other the oxygen partial pressure. The circuit arrangement of the circuit indicates the measured values on display devices which are worn on a wristband. The arrangement of the circuit further regulates the oxygen supply by actuation of the solenoid valve in such a way that selectively a constant partial pressure or a given percentage of oxygen is maintained in the cycle. If the oxygen partial pressure exceeds a limit value harmful to health, the circuit arrangement closes the solenoid disconnect valve until the oxygen value drops again, and it indicates overshooting by the flaring up of an alarm device. In addition, oxygen warning lamps inside the mask indicate whether the oxygen content is in the desired range or above or below it. For increased safety it is proposed to provide a second identical arrangement, in case a fault occurs in the first. As an additional monitoring device the measuring chamber contains a third sensor operating without outside energy which measures the oxygen partial pressure without connection with the circuit and indicates it on an independent gauge. In case of failure, the user can carry out by hand an emergency supply from the gas bottle containing inert gas-oxygen mixture via the two pushbutton valves.

The disadvantage is that despite complicated electronics and instrumentation the user is forced to recognize an occurring breakdown from observation of displays and signals and then to maintain an emergency supply while watching the displays by continued manual control operations which hinder him in the completion of his task or in his retreat. (see German No. OS 26 08 546).

SUMMARY OF THE INVENTION

The object of the present invention is to provide an electrically controlled respirator which works on the cycle or closed circuit principle, in which after failure of the electric control, switching to a mechanically controlled breathing air supply occurs automatically.

Accordingly, another object of the invention is to provide a closed cycle respirator comprising a respiration air cycle including a breathing bag, a carbon dioxide absorber and connecting lines therebetween and to a junction adapted for engagement by the user, a pressurized oxygen supply container connected to said cycle for supplying oxygen thereto, a controllable valve connected between said oxygen supply container and said cycle with sensing means in said bag to open said controllable valve with reduced oxygen in said bag, means defining a high pressure chamber connected to said container upstream of said controllable valve and a medium pressure chamber connected to said cycle downstream of said controllable valve, means defining a pre-pressure chamber connected between said high pressure chamber and said cycle, a valve having a movable valve member for closing said pre-pressure chamber to said high pressure chamber, a cylinder having a space communicating with said medium pressure chamber with a biased piston movable in said space with biasing means for moving said piston with a reduced pressure in said medium pressure space, and a lever connected between said piston and said valve member to move said valve member and open the communication between said high pressure chamber and said pre-pressure chamber with motion of said piston.

Upon failure of the electric system to control the correct oxygen level, and hence also of the control of breathing gas replenishment, a switching device mechanically turns on the oxygen replenishment by a different route. This is done in response to the pressure drop in said medium-pressure chamber which always occurs since the solenoid valve closed with a system failure, and the oxygen flows from the medium-pressure chamber into the breathing bag via the throttle. By a relaxing mechanical spring a valve is opened to a bypass line which leads into the breathing bag via a suitable pressure reducer. Thus the required supply of oxygen can be effected practically directly from the supply bottle. The solution is mechanically simple and also safety lodged in backpack equipment.

A further object of the invention is to provide a closed cycle respirator with emergency oxygen connection which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings in which a preferred embodiment of the invention is illustrated.

DESCRIPTION OF THE PREFERRED EMBODIMENT

Figure 1:
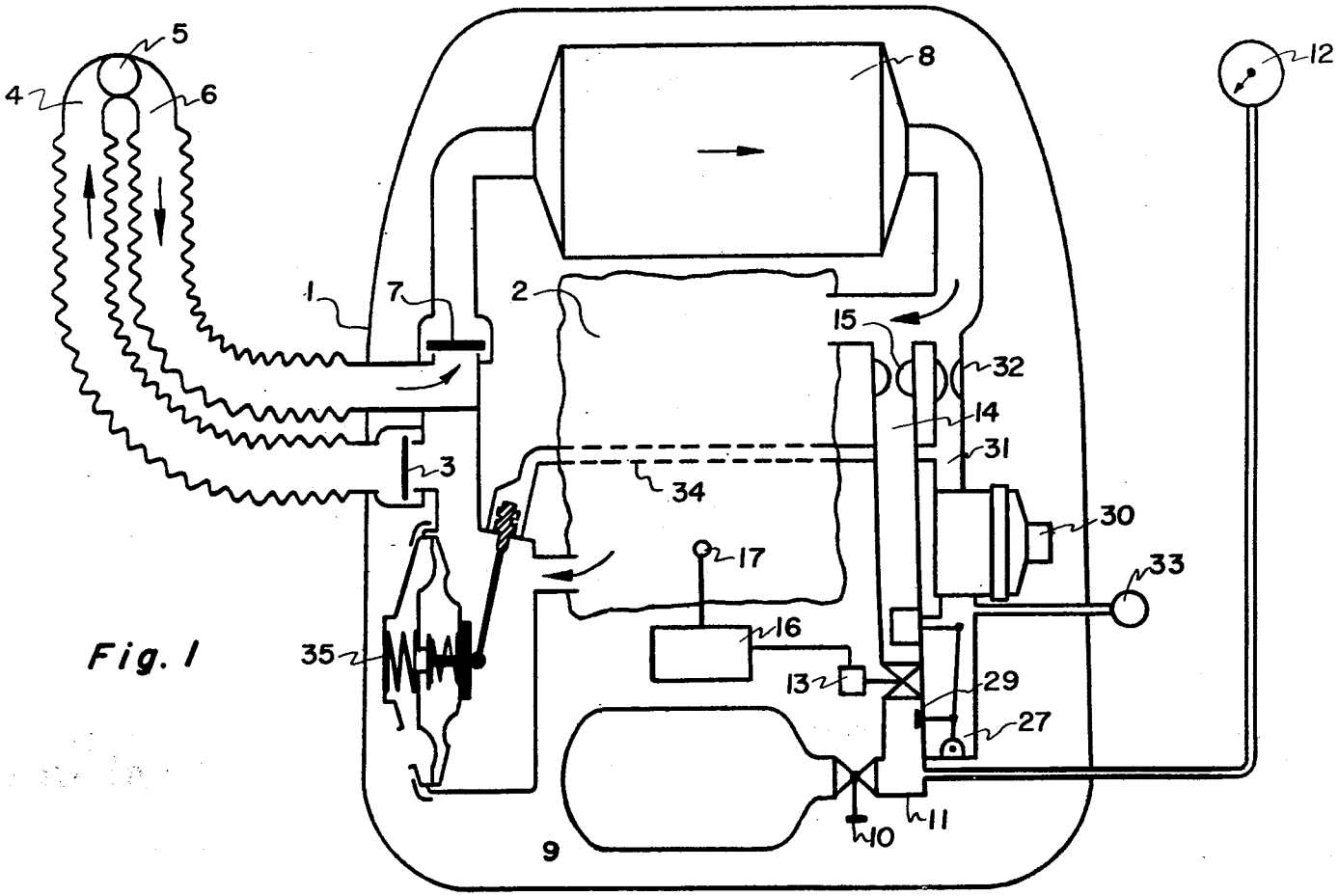
FIG. 1 is a diagrammatical view of a closed cycle respirator according to the invention.

Referring to the drawings in particular, the invention embodied therein, comprises a closed circuit respirator having a controllable valve for controllably supplying oxygen to a closed respiration circuit or cycle, and switching means for switching the connection of oxygen to the cycle in case of failure of the controllable valve or reduction of the oxygen in the respiration cycle for any other reason.

The respirator 1 operates on the cycle principle. The setup is shown in FIG. 1. The cycle is formed, in the order of the direction of flow in the inhalation section, by a breathing bag 2, an inhalation valve 3, an inhalation hose 4, and a breathing connection or junction 5. The exhaled air then passes via an exhalation hose 6, an exhalation valve 7 and an absorption cartridge 8, in which the $CO_2$ is combined or absorbed out of the air, back into the breathing bag 2. The oxygen consumed is replenished from a supply. To this end there is provided an oxygen bottle 9 equipped with a shut-off valve 10. Connected to the shut-off valve 10 is a high-pressure space or chamber 11, which is connected with the breathing bag 2 via a solenoid valve 13 and a medium-pressure space 14 equipped with a throttle 15. A pressure gauge 12 is connected to the high-pressure space 11 for monitoring.

The solenoid valve 13 is a part of an electric control device 16 and is controlled by the latter via an oxygen sensor 17 in the breathing bag 2. The throttle 15 is laid out so that at a minimum requirement of the equipment user of 1.2 liter O/2min, a pressure of about 0.5 bar builds up in the medium pressure space 14.

Figure 2:
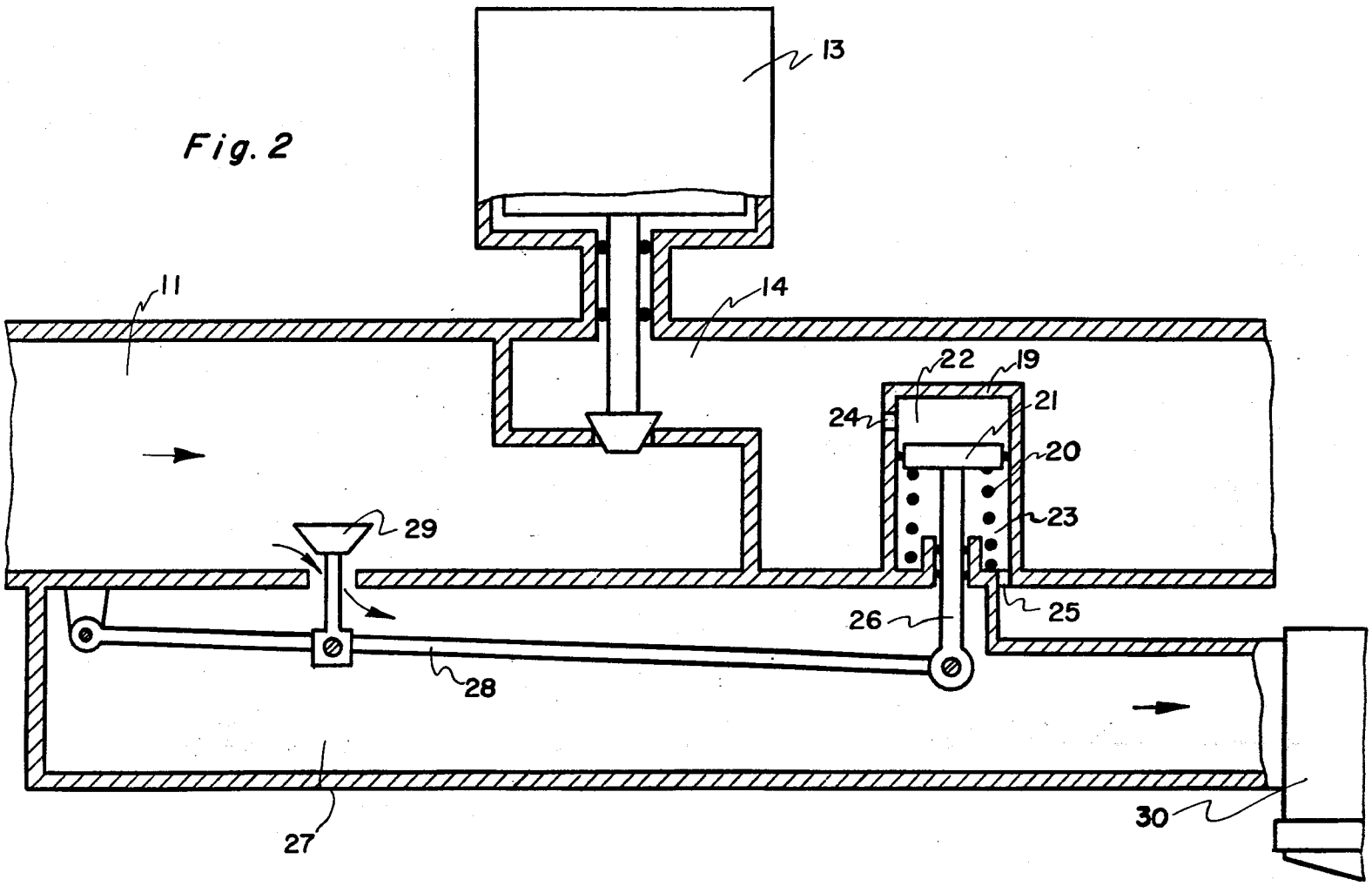
FIG. 2 is a detailed sectional view of the switching apparatus for supplying oxygen in case of reduced oxygen content in the breathing cycle.

FIG. 2 shows the switching arrangement in detail. The high-pressure space 11 is connected with the medium-pressure space 14 via the solenoid valve 13. In the medium pressure space 14 a control cylinder 19 is provided. Its interior is divided by a piston 21 loaded by a compression spring 20 into an internal space 23 above and a spring space 22 below. Space 22 communicates via an opening 24 with the medium-pressure space 14, and the spring space 23 via a compression opening 25 with the atmosphere or ambient. The piston rod 26 is hermetically guided into a pre-pressure space 27 and there articulated to a lever 28, which is connected with a valve having a valve member 29 between the high-pressure space 11 and the pre-pressure space 27 and actuates the valve.

Through the pressure prevailing in the medium-pressure space 14 when the solenoid valve 13 is open, which acts on piston 21 via the opening 24, piston 21 is pushed into its lower end position counter to the force of the compression spring 20 and valve 29 is closed. Upon failure of the electric control device 16, the solenoid valve 13 is no longer actuated; the connection between the high-pressure space 11 and the medium-pressure space 14 remains closed. As the oxygen flows out of the medium-pressure space 14 via the throttle 15, the pressure drops. Below a minimum pressure the compression spring 20 moves piston 21 into its upper end position and in so doing opens valve 29. The oxygen then flows without interruption of the supply to the user, via the pre-pressure space 27, a pressure reducer 30, a backpressure space 31 and a dosing opening 32, into the breathing bag 2. The backpressure space 31 is connected in known manner via a line 34 with the automatic lung 35. A signal device 33 at the pre-pressure space 27 indicates the pressure rise and hence an effected switching.

While a specific embodiment of the invention has been shown the described in detail to illustrate the application of the principles of the invention, it will be understood that the invention may be embodied otherwise without departing from such principles.

What is claimed is:

1. A closed circuit respirator comprising:

a breathing bag having an inlet and an outlet, a carbon dioxide absorber having an inlet and an outlet, a junction adapted for engagement by a user having an inlet and an outlet, conduit means connecting the outlet of said junction to the inlet of said carbon dioxide absorber, the outlet of said carbon dioxide absorber to the inlet of said breathing bag and the outlet of said breathing bag to the inlet of said junction to define a closed respiration air circuit;

a pressurized oxygen supply container connected to said air circuit for supplying oxygen to said air circuit;

a normally closed controllable valve connected between said oxygen supply container and said air circuit with sensing and control means for sensing oxygen in said breathing bag and opening said controllable valve with reduced oxygen in said bag;

means defining a high-pressure pressure chamber connected between said container and said controllable valve upstream of said controllable valve and a medium pressure chamber connected between said air circuit and said controllable valve downstream of said controllable valve;

means defining a pre-pressure chamber connected between said high-pressure chamber and said air circuit;

a further valve having a valve member connected between said pre-pressure chamber and said high-pressure chamber and movable for opening said pre-pressure chamber to said high-pressure chamber;

a cylinder connected to said medium pressure chamber;

a biased piston movable in said cylinder and dividing said cylinder into first and second compartments, said first compartment communicating with said medium-pressure chamber, said second compartment communicating to atmosphere, biasing means for moving said piston toward said first compartment with the occurrence of a reduced pressure in said medium pressure chamber due to a failure of said sensing and control means which closes said controllable valve; and lever means connected between said piston and said valve member to move said valve member to open the connection between said high-pressure chamber and said pre-pressure chamber when said piston moves toward said first compartment caused by said reduction in pressure in said medium-pressure chamber and to close when said piston moves toward said second compartment caused by an increased pressure in said medium-pressure chamber.

2. A closed circuit respirator according to claim 1, including an automatic lung in said respiration air circuit having a further valve member movable with reduced pressure in said respiration air circuit and an oxygen line connected between said pre-pressure chamber and said further valve member for supplying oxygen to said respiration air circuit directly over said pre-pressure chamber.

3. A closed circuit respirator according to claim 1, wherein said controllable valve comprises an electrically controllable solenoid valve, said control and sensing means comprises a sensor in said breathing bag and a controller connected to said sensor and to said solenoid valve.

4. A closed circuit respirator according to claim 1, including a throttle in said medium pressure chamber for throttling oxygen supplied to said circuit and a throttle in said pre-pressure chamber, and a pressure reducer in said pre-pressure chamber between said throttle and said valve member.

5. A closed circuit respirator according to claim 1, including a pressure indicator connected to each of said high and pre-pressure chambers for indicating pressure in said high and pre-pressure chambers respectively.

6. A closed circuit respirator according to claim 1, wherein said respiration air circuit comprises an inhalation line connected between said air bag and said junction, an exhalation line connected between said junction and said carbon dioxide absorber and a further line connected between said carbon dioxide absorber and said bag with one way valves in said inhalation and exhalation lines for flow through said junction and from said junction respectively.

7. A closed circuit respirator according to claim 6, wherein said medium pressure chamber and said pre-pressure chamber are connected through throttles to said further connecting line between said carbon dioxide absorber and said breathing bag.

8. A closed circuit respirator according to claim 7, including an oxygen supply line between said pre-pressure chamber upstream of the throttle thereof and said inhalation line, an automatic lung having a valve member connected in said inhalation line upstream of the one way valve therein for opening said automatic lung valve member with reduced pressure in said inhalation line to supply oxygen over said oxygen line from said pre-pressure chamber.

* * * * *